United States Patent [19]

Trumbull

[11] Patent Number: 4,886,243

[45] Date of Patent: Dec. 12, 1989

[54] HYDRAULIC JACK RAMP

[76] Inventor: Christopher J. Trumbull, Rte. 1, Box 191-A, Jane Lew, W. Va. 26378

[21] Appl. No.: 262,746

[22] Filed: Oct. 26, 1988

[51] Int. Cl.[4] ..... E02C 3/00

[52] U.S. Cl. ..... 254/88; 254/8 R; 254/93 R

[58] Field of Search ..... 254/2 R, 2 B, 2 C, 8 R, 254/8 B, 8 C, 93 R, 93 H, 88, 89 R, 91

[56] References Cited

U.S. PATENT DOCUMENTS

| | | | |
|---|---|---|---|
| 1,459,954 | 6/1923 | Hancock | 254/88 |
| 2,575,160 | 11/1951 | Clarke . | |
| 2,924,427 | 2/1960 | Larson | 254/88 |
| 3,632,085 | 1/1972 | Traywick | 254/93 R |
| 3,648,856 | 3/1972 | Gaarder . | |
| 3,664,635 | 5/1972 | Kincaid . | |
| 3,807,694 | 4/1974 | Butorac . | |
| 3,847,376 | 11/1974 | Binding | 254/88 |
| 3,946,886 | 3/1976 | Robinson . | |
| 4,077,607 | 3/1978 | Lovelady | 254/88 |
| 4,625,944 | 12/1986 | Mankey . | |

FOREIGN PATENT DOCUMENTS

| | | | |
|---|---|---|---|
| 489483 | 7/1938 | United Kingdom | 254/88 |

*Primary Examiner*—Judy Hartman
*Attorney, Agent, or Firm*—Leon Gilden

[57] ABSTRACT

A hydraulically elevatable ramp apparatus is set forth wherein a ramp formed of an upper and lower portion with a pivotal hinge joining the two portions secured to a hydraulic jack at a forwardmost position. The ramp at a first lowered position accepts vehicles of diminished ground clearance wherein the vehicle is thereafter elevated to a second position whereupon the lower hinged portion is automatically repositioned upon elevation of the upper portion. The jack is formed with a resilient pad to insure a non-slip arrangement upon elevating a vehicle to a second elevated position.

1 Claim, 6 Drawing Sheets

HYDRAULIC JACK RAMP

BACKGROUND OF THE INVENTION

1. Field of the Invention

The field of invention relates to hydraulic jacks, and more particularly pertains to a new and improved hydraulic jack ramp wherein the same may be positioned for accepting motor vehicles of reduced ground clearance.

2. Description of the Prior Art

The use of various hydraulic lifting devices is well known in the prior art. Contemporary automotive construction, however, has effected the configuration of a variety of automobiles with limited ground clearance due to the additional acceptance of such accessories as "airdam" and the like reducing the degree of angularity available to such an automobile in ascending a typical ramp.

Hydraulic jacks have heretofore been of conventional configuration and construction, as evidenced for example by U.S. Pat. No. 3,807,694 to Butorac setting forth a conventional hydraulic jack employing mechanical linkage operably associated with a lifting pad and a hydraulic cylinder to elevate an associated vehicle.

U.S. Pat. No. 3,632,085 to Traywick sets forth a hydraulic jackk with a forward securement pad for positioning upon a support surface in combination with a rear plurality of spaced wheels whereupon the jack may be slid under an associated vehicle for elevating the same to a predetermined height.

U.S. Pat. No. 2,575,160 to Clarke sets forth a hydraulic lifting jack wherein a slidable rear hydraulic portion is arranged in a toggle link fashion to a forward lifting pad to elevate a vehicle positioned thereover.

U.S. Pat. No. 3,946,886 to Robinson sets forth a hydraulic towing device for use with small airplanes wherein a forwardly mounted winch device cooperates with a forward oriented ramp to draw an airplane over the ramp by action of the winch.

U.S. Pat. No. 4,625,944 to Mankey sets forth a hydraulic safety device wherein a cylinder is operatively connected to a lifting mechanism wherein the safety device includes a counterbalance valve operably associated with a cylinder for preventing the lowering of an associated load in response to the application of hydraulic pressure applied thereto.

U.S. Pat. No. 3,648,856 to Gaarder sets forth a jack with a forward and a rearward pair of wheels wherein a forward lifting pad is associated with a leveling assembly at a forward end of the jack for use particularly in the facilitating of bulky and awkward vehicle transmission as they are installed or removed from associated vehicles.

U.S. Pat. No. 3,664,635 to Kincaid set forth a hydraulic lifting arrangement of conventional configuration with a spaced plurality of wheel pairs wherein a plurality of pressure chambers in alignment within the framework of the jack enables the cylinders to be simultaneously activated for the lifting of vehicles and the like.

As such, it may be appreciated that there is a continuing need for a new and improved hydraulic jack ramp apparatus wherein the same is configured for accommodation of vehicles of diminished ground clearance.

SUMMARY OF THE INVENTION

In view of the foregoing disadvantage inherent in the known types of hydraulic jacks now present in the prior art, the present invention provides a hydraulic jack ramp apparatus wherein the same may be compactly stored during periods of non-use and may thereafter be extended to accommodate vehicles of diminished ground clearance. As such, the general purpose of the present invention, which will be described subsequently in greater detail, is to provide a new and improved hydraulic jack ramp apparatus which has all the advantages of the prior art hydraulic jacks and none of the disadvantages.

To attain this, the present invention comprises a hydraulic jack formed with an upper and lower ramp portion wherein the lower portion may be overfolded to the upper portion during periods of non-use and may be thereafter extended for accommodation of vehicles at a first height and thereafter elevated to a second height. The apparatus further includes a friction pad secured to a forward foot to maintain the apparatus in a predetermined orientation relative to an associated vehicle.

My invention resides not in any one of these features per se, but rather in the particular combination of all of them herein disclosed and claimed and it is distinguished from the prior art in this particular combination of all of its structures for the function specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hydraulic jack ramp apparatus which has all the advantages of the prior art hydraulic jack ramp apparatus and none of the disadvantages.

It is another object of the present invention to provide a new and improved hydraulic jack ramp apparatus which may be easily and efficiently manufactured and marketed.

It is a further object of the present invention to provide a new and improved hydraulic jack ramp apparatus which is of a durable and reliable construction.

An even further object of the present invention is to provide a new and improved hydraulic jack ramp apparatus which is susceptible of a low cost of manufacture with regard to both materials and labor, and which accordingly is then susceptible of low prices of sale to the consuming public, thereby making such hydraulic jack ramp apparatus economically available to the buying public.

Still yet another object of the present invention is to provide a new and improved hydraulic jack ramp apparatus which provides in the apparatuses and methods of the prior art some of the advantages thereof, while simultaneously overcoming some of the disadvantages normally associated therewith.

Still another object of the present invention is to provide a new and improved hydraulic jack ramp apparatus wherein the same is provided with a frictional foot underlying a second portion pivotally hinged to a forward first portion for accommodating vehicles of reduced ground clearance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is a top orthographic view of a foot as utilized by the instant invention.

DESCRIPTION OF THE PREFERRED EMBODIMENT

Figure 1:
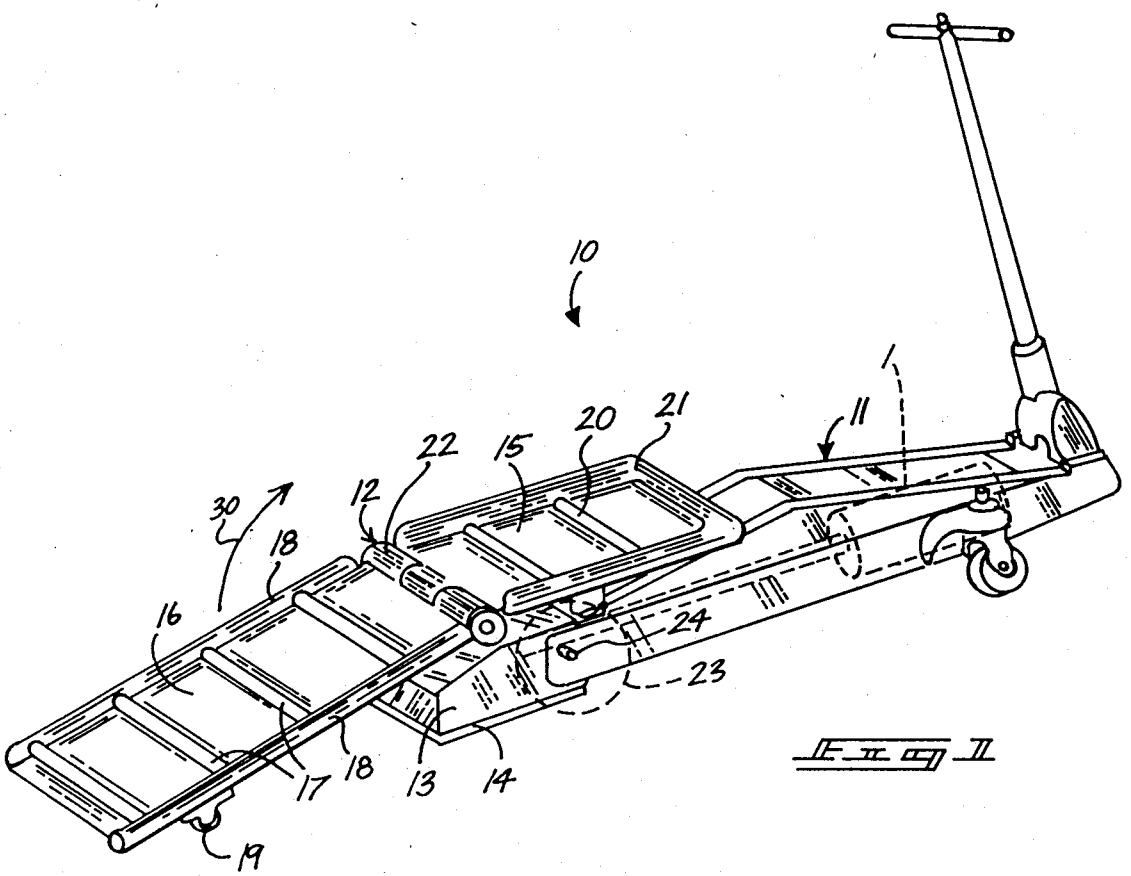
FIG. 1 is an isometric illustration of the instant invention.
Figure 2:
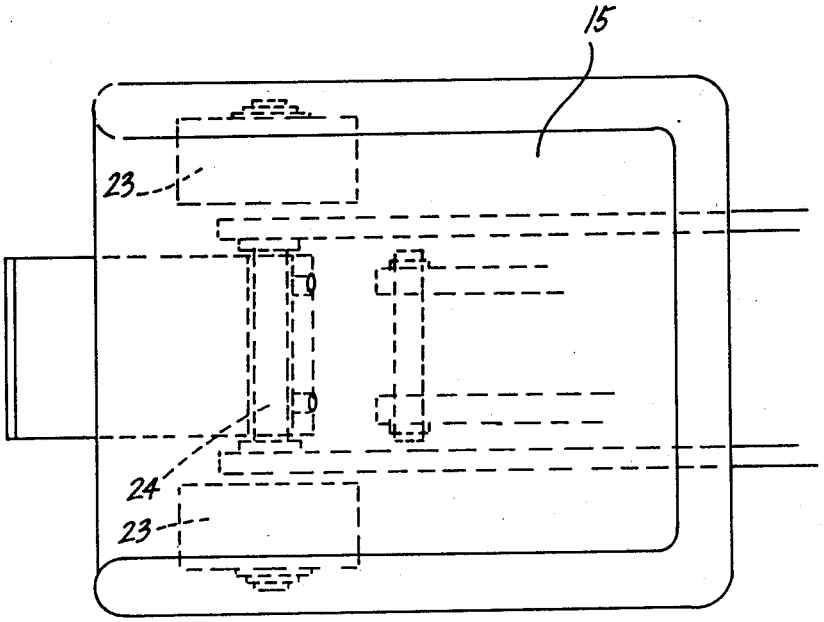
FIG. 2 is an orthographic top view of the top ramp portion of the instant invention.

With reference now to the drawings, and in particular to FIGS. 1 to 11 thereof, a new and improved hydraulic jack ramp apparatus embodying the principles and concepts of the present invention and generally designated by the reference numeral 10 will be described.

More specifically, the hydraulic jack ramp apparatus 10 essentially comprises a hydraulic jack formed with a conventional hydraulic cylinder (1) with a rearwardly positioned activation handle of conventional configuration and cooperation. A plurality of rear pivotal wheels are positioned to a rearward portion of the frame of the jack 11 to enable enhanced positioning of the apparatus 10. A forward pivoted ramp assembly 12 is secured to a lifting link of the hydrauic jack 11 which in turn is operably secured to the hydraulic cylinder in a manner of conventional configuration.

Figure 3:
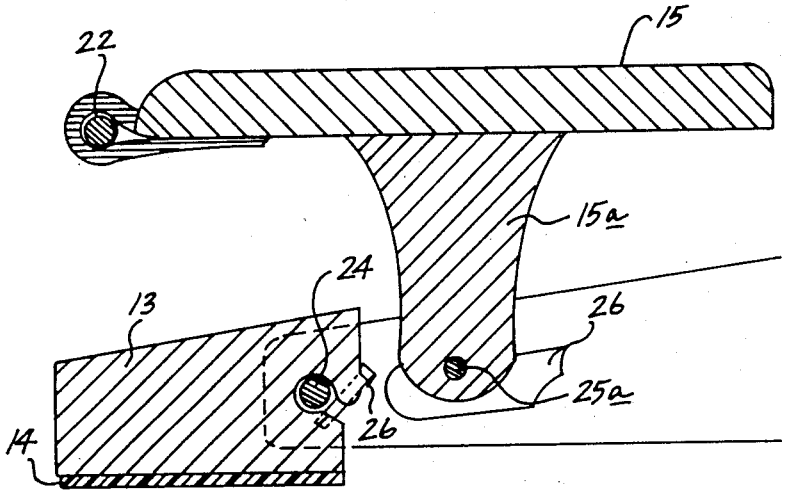
FIG. 3 is an orthographic cross-sectional view illustrating the orientation of the top ramp portion relative to the forward securement foot of the instant invention.
Figure 4:
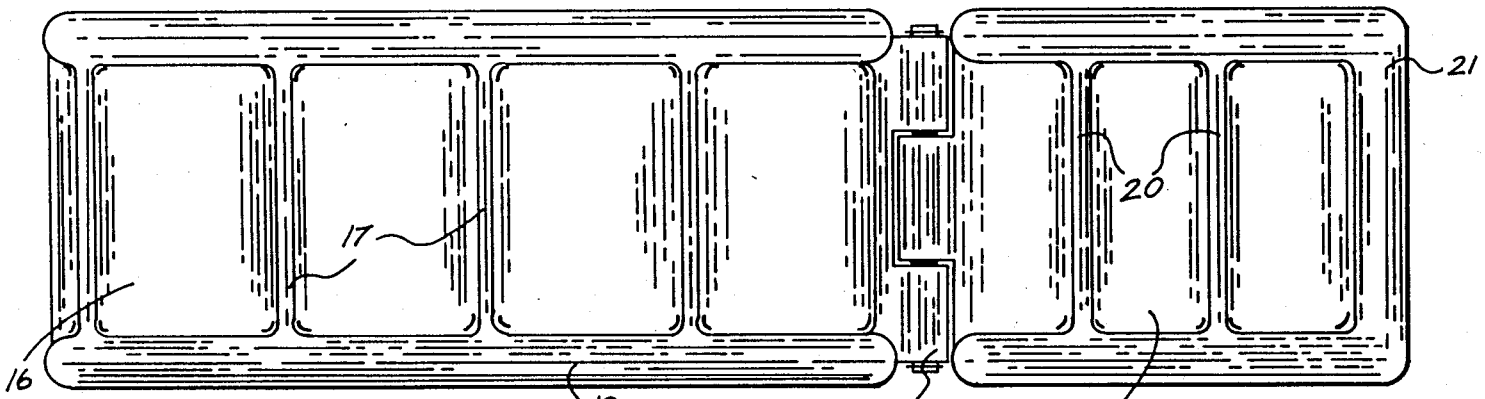
FIG. 4 is an orthographic to view of the lower and top ramp portions of the instant invention.
Figure 5:
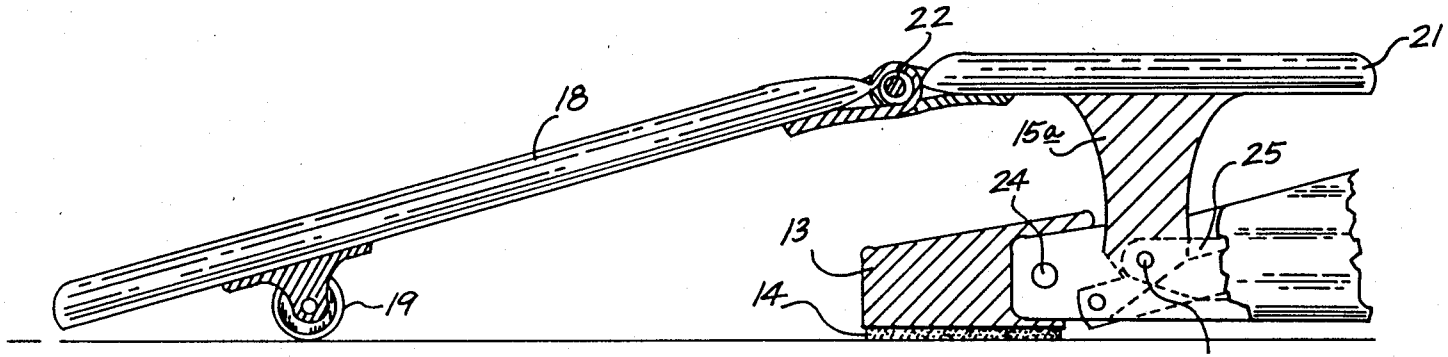
FIG. 5 is an orthographic view taken in elevation of the lower and top ramp portions oriented to the hydraulic jack.

The hydraulic jack ramp apparatus 10 is formed with a foot 13 secured to a forward axle 24 of the jack 11 and is provided with an underlying resilient friction surface 14 for secure positioning of the apparatus when in use. A pivoted ramp assembly 12 is secured to the lifting link including a top ramp portion 15 pivotally secured to a lower ramp portion 16. Reference to FIG. 3 illustrates a support pedestal **15*a* integrally secured underlying the top ramp portion 15 and secured by use of a link axle 25*a* to the lifting link 25 of the jack 11**.

The lower ramp portion 16 is formed with a pair of spaced guard rails 18 coextensive with either side of the lower ramp portion 16 and formed with a series of spaced traction ribs 17 to enhance traction of a vehicle ascending the lower ramp portion 16. A plurality of rollers 19 are secured underlying the lower end portion 16 to enhance the pivoted positioning of the lower ramp 16 relative to the upper ramp 15 during a lifting of the ramp portion 15 during a jacking procedure.

The top ramp portion 15 is further formed with a continuous "U" shaped upper guard 21 including a plurality of parallel spaced side legs and a rear leg to provide a continuous protection arrangement with a vehicle's tire positioned on the top ramp portions 15 surface. The top and lower ramp portions 15 and 16 respectively are interconnected by a pivot hinge 22 to enable repositioning of the lower portion 16 relative to the top ramp portions 15 during a jacking maneuver. The hydraulic jack 11 is formed with a plurality of removable forward wheels 23 that are removed prior to a jacking procedure and are merely replaced when it is desirable to store and maneuver the ramp apparatus 10 between periods of used. As illustrated in FIG. 1, the forward wheels 23 are of a diameter to extend beyond the friction surface 14 to enable free repositioning and rolling of the apparatus 10, as desired. During such storage and maneuvering of the apparatus, the lower ramp portion 16 is pivoted to an overlying position relative to the top ramp portion 15 in a folding direction 30, as illustrated in FIG. 1.

Figure 8B:
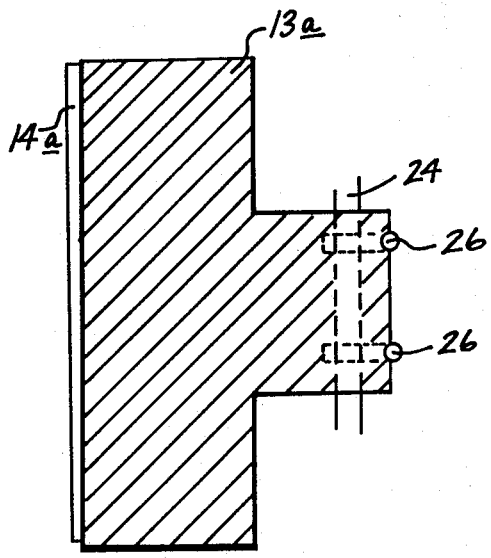
FIG. 8 is an orthographic frontal view of the positioning foot of the instant invention.
Figure 9:
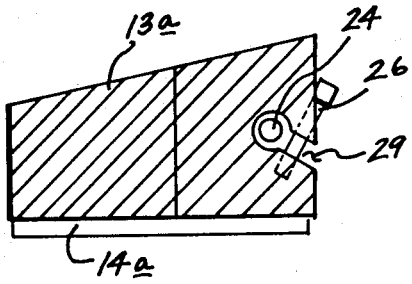
FIG. 9 is an orthographic side view of a modified positioning foot, as illustrated in FIG. 8.
Figure 11:
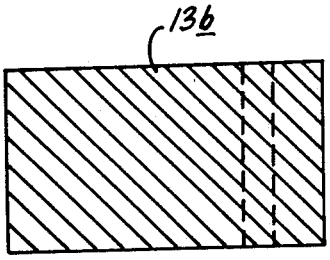
FIG. 11 is a side orthographic view taken in elevation of the foot, as illustrated in FIG. 10.
Figure 12:
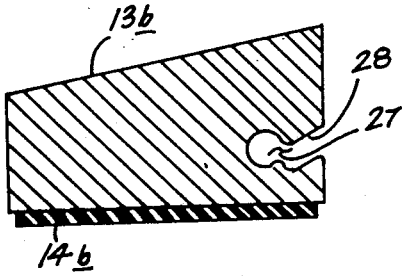

The foot 13 is secured to the forward axle 24 by a plurality of lock bolts 26, as illustrated in FIG. 3 for example. FIGS. 8 and 9 illustrate a first modification of the foot depicting a foot **13*a* of generally "T" shaped configuration to provide an enhanced friction surface extending beyond the side frame portions of the jack 11. The foot 13*a* utilizes a downwardly depending channel 29 to accept the axle 24 within a through extending bore wherein upon the lock bolts 26 secure the foot therein. Recourse to FIGS. 10 and 11 illustrate a further modification of the foot 13 depicted as foot 13*b* with an upwardly depending channel 27 through which the axle 24 is guided to be received within the axle receiving bore 28. The upwardly depending bore 27 eliminatess the need for the lock fasteners 26 wherein the axle 24 is maintained in position wherein the bore 28 due to the downwardly reacting forces locking the axle 24 within the bore 28** during a jacking procedure.

Figure 6:
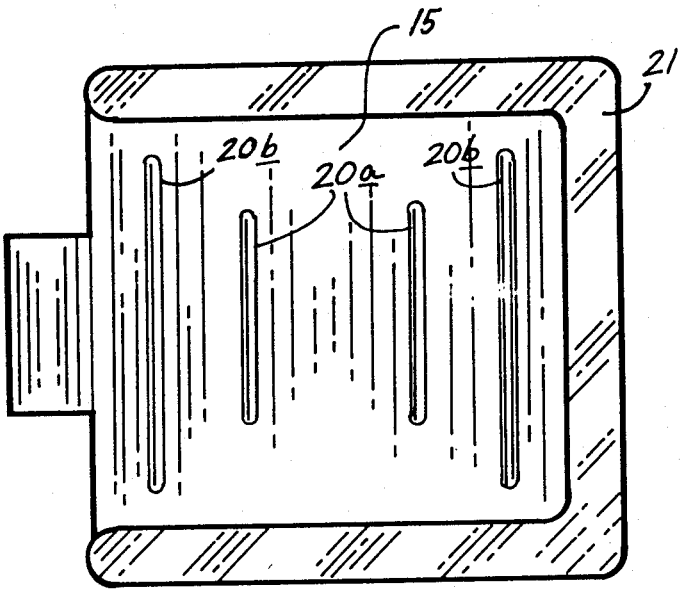
FIG. 6 is a top orthographic view of a modified top ramp portion.
Figure 7:
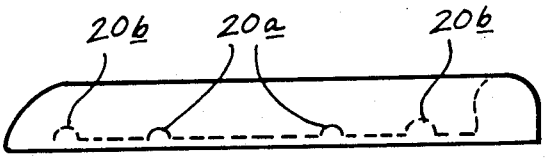
FIG. 7 is an orthographic side view of the modified top ramp portion.

FIGS. 6 and 7 are illustrative of a modified top plate portion formed with modified traction ribs **20*a* and 20*b*** wherein the central traction ribs 20a are substantially of ⅛th inch in height and the exteriorly positioned traction ribs 20b are of ¼ inch in height to assist in maintaining a vehicle's tire in a centralized orientation on the top ramp portions 15 support surface.

In use thereof, vehicles of limited ground clearance may approach the ramp apparatus when in a lowered or first position when the top ramp portion is substantially six inches high and thereafter the top ramp portion may be lifted to a second position of approximately thirteen to fifteen inches in height and thereby avoid engaging body portions of the aforementioned vehicle.

As to the manner of usage and operation of the instant invention, the same should be apparent from the above description and accordingly no further discussion relative to the manner of use and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hydraulic vehicular ramp jack apparatus comprising, a jack member including a plurality of spaced frame rails housing motive means operatively secured to at least one lifting link, and a friction means positioned at a forward end of said jack member for frictionally anchoring the forward end of said jack member, and a ramp means operatively secured to said lifting link and overlying said friction means for accepting and lifting a vehicle thereon, and wherein said ramp means includes a top ramp portion secured to said lifting link and a lower ramp portion pivotally secured to said top ramp portion, and wherein said friction means is secured to a forward axle of said jack member wherein a plurality of wheels are selectively securable to exterior terminal ends of said axle, and wherein said lower ramp portion includes a pair of spaced guide rails coextensively integrally formed to sides of said lower ramp portion with a plurality of traction ribs integrally secured to said lower ramp portion between said guard rails, and wherein said top ramp portion includes a "U" shaped guard rail integrally formed to a perimeter of said top ramp portion with a plurality of top traction ribs secured to said top ramp portion, and wherein said top traction ribs include a plurality of parallel first ribs of a first length depending upwardly of a surface of said top ramp portion a distance substantially equaling ⅛th inch and a plurality of parallel second ribs positioned exteriorly of said first ribs between said "U" shaped guard rail extending upwardly of said top ramp portion surface ¼ inch of a second length greater than the first length, and wherein said friction means includes a foot with an axle receiving bore directed transversely of said foot with an upwardly depending channel depending from said bore for directing said axle into said axle receiving bore, and wherein said lower ramp portion includes a plurality of rollers secured to a forward underlying surface of said lower ramp portion.

* * * * *